United States Patent [19]

Middleton

[11] 4,104,638

[45] Aug. 1, 1978

[54] COOPERATIVE TYPE ANTI-COLLISION RADIO SYSTEM

[76] Inventor: Raymond R. Middleton, 1203 W. 16th St., Topeka, Kans. 66604

[21] Appl. No.: 699,019

[22] Filed: Jun. 23, 1976

[51] Int. Cl.[2] ..... G08G 5/04

[52] U.S. Cl. ..... 343/112 CA; 325/22

[58] Field of Search ..... 343/112 CA, 112 A; 325/22

[56] References Cited

U.S. PATENT DOCUMENTS

| | | | |
|---|---|---|---|
| 2,894,258 | 7/1959 | Vantine, Jr. et al. | 325/22 X |
| 3,227,954 | 1/1966 | Fichter, Jr. | 325/22 |
| 3,584,302 | 6/1971 | Lundgren | 325/22 |
| 3,646,508 | 2/1972 | Da Silva | 325/22 X |
| 3,750,168 | 7/1973 | Schrader et al. | 343/112 CA |
| 3,757,339 | 9/1973 | Shear et al. | 343/112 CA |

OTHER PUBLICATIONS

"Avionics Navigation Systems", M. Kayton & W. R. Fried, John Wiley & Sons Inc., New York, pp. 605–608.

*Primary Examiner*—Maynard R. Wilbur
*Assistant Examiner*—Richard E. Berger
*Attorney, Agent, or Firm*—James L. Jackson

[57] ABSTRACT

A cooperative type aircraft anti-collision radio system utilizes radio transmitters and receivers transmitting and receiving on a single radio frequency common to most aircraft having radio systems or on multiple radio frequencies if desired. Each aircraft will be capable of transmitting at least one and preferably a plurality of selected tones which may be received by appropriate radio receiver circuitry of other aircraft operating in the vicinity. Conventional automatic direction finding circuitry ascertains the bearing of the aircraft transmitting a modulated tone or tones which is displayed for visual inspection. By interpreting changes in the bearing of the aircraft transmitting the tone or tones and/or by interpreting the strength of the signals being received a decision may be made whether or not evasive action is required in order to avoid a collision. The decision may also be made automatically by computer depending upon the degree of sophistication desired advising the pilot to fly his aircraft upwardly, downwardly, to the right, left, or level in order to avoid collision. For aircraft including both transmitter and receiver circuitry the transmitter and receiver are both operative through a plurality of switching circuits provided one for each of the tones being transmitted and received. The switching circuits are energized according to codes that are unique to each aircraft so the codes of two aircraft will never correspond exactly thereby assuring reception of at least one position signal between any two aircraft equipped with transmitting and receiving anti-collision radio systems.

13 Claims, 2 Drawing Figures

COOPERATIVE TYPE ANTI-COLLISION RADIO SYSTEM

BACKGROUND OF THE INVENTION

Figures 1, 2:
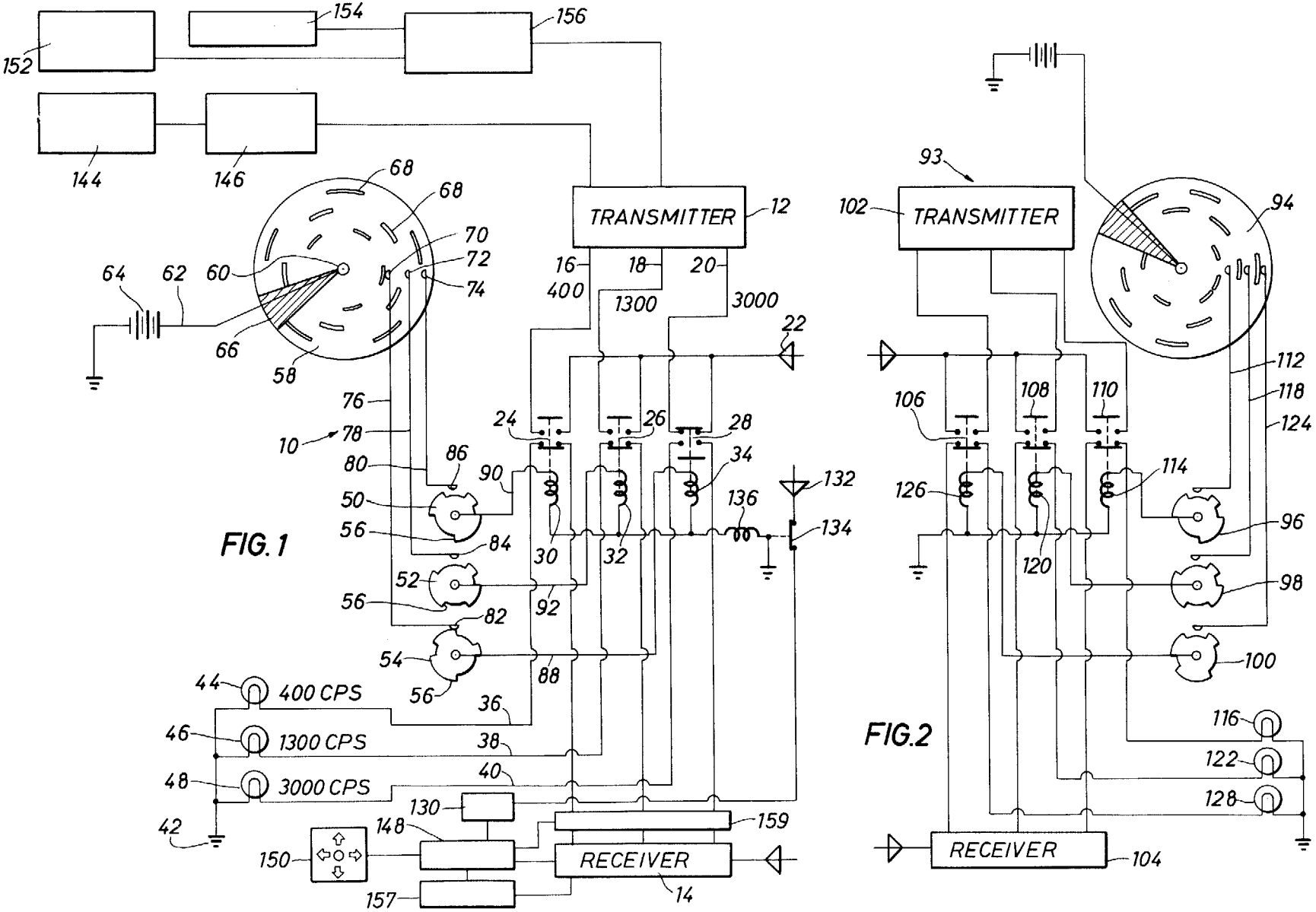

The instant invention relates generally to radio communication between moving vehicles of any desirable character and more particularly to a cooperative radio type anti-collision system for moving aircraft and other moving vehicles. While the invention is applicable to automobiles, trains, boats, and other vehicles traveling on the earth's surface and fixed objects the invention will be described in its application to flying aircraft for the purpose of simplicity.

With the increased volume of aircraft traffic presently operating through the airways and about the airports today the problem of possible aircraft collision is a major problem indeed even though air traffic control is generally considered to be superior. Rapid technology in the aircraft industry has led to the development of extremely large high speed jet aircraft which present problems regarding possible collision simply because of the great speeds at which they travel. Upon approaching an airport high speed jet aircraft are virtually always flying on a controlled approach course and frequently must aproach the airport under instrument control. It is possible for the other aircraft to enter the controlled zone unknowingly thereby creating a hazard to controlled aircraft operating under approach control. Since there are a great many more non-commercial type aircraft, frequently of small inexpensive variety, it is quite obvious that non-commercial aircraft present a hazard of possible collision that is aggravated simply by the number of aircraft that may be operating in the vicinity of an airport.

There is a need for aircraft to be capable of identifying a potential collision course with other aircraft regardless of the type or size of aircraft involved in order that evasive maneuvering may be timely accomplished in order to prevent collision with other aircraft operating in the area. It is desirable that all aircraft at least have sufficient radio gear for transmission of a signal in order that other aircraft operating nearby may receive the transmitted signal and locate the other aircraft. In the event the proximity, range, and direction of flight of the other aircraft indicate a possible collision hazard the aircraft receiving the transmitted signal may take evasive action and maneuver to prevent a possible collision.

When the wide variations in operating speeds and operating characteristics are considered carefully it becomes apparent that distance between operating aircraft becomes a relatively unimportant factor while the factor time takes on a more dominant character. For example two high speed aircraft might be several miles apart and yet because of their great speed the time to possible collision may be relatively short while two slow flying aircraft may be relatively close together and the time to possible collision might be relatively long. Also the angle at which the aircraft are approaching one another represents a factor in determining the time to possible collision. It is desirable that an anti-collision radio system be capable of determining the time to possible midair collision regardless of the relative headings and speeds of the aircraft involved.

A number of aircraft control systems are presently employed most of which utilize radar in order to locate other aircraft operating in the area. Radar direction finding equipment of ordinary sophistication has limited accuracy when considering the parameters required for aircraft anti-collision systems. The radar equipment must measure the aircraft location, the aircraft rate of position change, as well as comparing the altitude of other aircraft operating in the area. When radar anti-collision systems are provided with sufficient sophistication in order to provide the accuracy required such systems are of such extreme expense that all but the most expensive of aircraft are eliminated.

Cooerative type radio collision avoidance systems have also been developed but the degree of electrical or electronic sophistication of such systems frequently require relatively complex and expensive radio equipment in order to provide a sufficiently sensitive and reliable and fast acting system for the service required. Moreover, cooperative aircraft anti-collision systems frequently require radio gear that is extremely heavy thereby virtually eliminating small private aircraft having a limited weight carrying capacity. Private aircraft, therefore, constituting the major problem with respect to collision avoidance, would not ordinarily be provided with collision avoidance type radio gear thereby rendering the system ineffective for most private aircraft.

SUMMARY OF THE INVENTION

It is therefore a principal object of the present invention to provide a novel aircraft anti-collision radio system that is of sufficiently inexpensive nature as to allow all aircraft regardles of the cost or weight carrying capability thereof to be provided with a radio controlled system for collision avoidance.

It is another object of my invention to provide a novel radio controlled aircraft collision avoidance system that both broadcasts and receives transmissions on radio gear of the same frequency.

It is an even further object of my invention to provide a novel radio controlled anti-collision system for aircraft that is capable of receiving transmitted signals simultaneously from a plurality of aircraft operating in the immediate area.

Among the several objects of my invention is contemplated the provision of a novel radio controlled aircraft collision avoidance system utilizing the marker beacon tones presently transmitted at a frequency of 75 MHZ in order to provide an anti-collision system that is compatible with radio gear presently employed in most aircraft.

It is an even further object of my invention to provide a novel radio controlled collision avoidance system for aircraft utilizing radio circuitry that transmits signals in accordance with an aircraft identity code that is different from each aircraft incorporating an anti-collision radio system and being so arranged that the radio system of all aircraft will be capable at all times of hearing at least one transmitted position signal thereby assuring positive identification of another operating in the immediate area.

The present invention also contemplates the provision of a novel radio controlled aircraft collision avoidance system that includes a switching circuit which may be electrically or electronically controlled for each of the marker beacon tones being transmitted and which switching circuits allow alternate transmission and receiving of radio signals in accordance with the coded sequence determined by the combined effects of an aircraft identity code and a switching circuit for each tone being transmitted or received.

Another important object of my invention includes the provision of a novel radio controlled aircraft anti-collision system that is capable of allowing various latitudes of sophistication in order to allow all aircraft to be provided with at least minimal requirements whereby an aircraft may be capable of locating any other aircraft that may be flying in the immediate vicinity on a course that might raise the danger of collision.

It is an even further object of this invention to provide a novel anti-collision radio system for aircraft which, in addition to the transmission of a plurality of tone signals for the purpose of location, also transmits the altitude and altitude rate of change of the aircraft in the form of other selected tones thereby allowing other aircraft to positively identify the altitude of the aircraft transmitting the signal.

It is an even further object of this invention to provide a novel anti-collision radio system for aircarft which upon receiving a tone signal indicating possible collision and executing an evasive maneuver will transmit a radio signal in the form of a command that is received by other aircraft radio receiver circuitry and will command this aircraft to take opposite evasive action or to remain on a level course in order to avoid collision.

It is another object of my invention to provide a novel anti-collision radio system for aircraft whereby appropriate radio receiver circuitry may be provided to identify the amount of time to possible collision, thereby advising the pilot of the time in which an evasive maneuver must be accomplished.

The above and other objects and novel features of the instant invention will be readily apparent from the following description taken in conjunction with the accompanying drawings. It is to be expressly understood that the drawings are for the purpose of illustration and are not intended to define the limits of the invention but rather merely illustrate preferred embodiments and structures incorporating the features of the instant invention.

In the accompanying drawings forming a part of this specification and wherein like reference numerals are employed to designate like parts;

FIG. 1 is a schematic illustration of electrical circuitry including the basic transmitter and receiver circuitry of this invention and including altitude tone modulation circuitry and a command signal computer and associated circuitry for the transmitter and including altitude comparator circuitry and command tone receiver and computer circuitry for the receiving portion of the collision avoidance system.

FIG. 2 is a schematic illustration of electrical circuitry composing the basic transmitter and receiver circuitry for an aircraft collision avoidance system constructed in accordance with the present invention.

Referring now to the drawings for a more detailed understanding of this invention reference character 10 generally indicates an aircraft anti-collision radio system including a transmitter 12 and a receiver 14 that are capable of transmitting radio signals on a common radio frequency such as the 75 MHZ radio frequency presently utilized in most aircraft to identify the boundary markers of most airports. For example the transmitter 12 is shown to include three transmission circuits 16, 18, and 20 that continually transmit boundary marker signals of 400 CPS, 1300 CPS, and 3000 CPS, respectively, on the carrier transmission frequency fo 75 MHZ. A transmission antenna 22 is provided for the transmitter circuitry and is selectively connected to the transmitter circuitry through three switches 24, 26, and 28 which are provided one for each of the circuits 16, 18, and 20, respectively. As illustrated in the drawings the switches, 24, 26, and 28 are mechanical switches actuated from a normal or receive position as illustrated at 24 and 26 to an actuated or transmit position as illustrated at 28 by electromagnets 30, 32, and 34, respectively. It is to be understod that switching circuitry may be provided in solid state rather than electromechanical form in order to achieve the switching operation. For example as illustrated in FIG. 1 the switches 24 and 26 will be open preventing transmission of signals through circuits 16 and 18, but switch 28 will be closed thereby allowing transmission of signals through the circuit 20 to the antenna circuit 22. The antenna circuit 22 therefore will be transmitting only a single 3000 CPS tone on the 75 MHZ carrier frequency.

For the purpose of receiving signals transmitted from the anti-collision radio systems of other aircraft the circuitry illustrated in FIG. 1 includes three indicator circuits 36, 38, and 40 that are connected respectively to the switches 24, 26, and 28 and are connected in parallel with a common ground 42. Illuminators 44, 46, and 48 are provided respectively for the circuits 36, 38, and 40 for energization when one or more of the three tones are received. Audible indicating means may also be employed to advise the pilot of the change in conditions. If for example the receiver 14 were receiving a tone of 400 or 1300 CPS the illuminator 44 or 46 would be energized through switch 24 or 26 which are disposed in the receive position. For the purpose of actuating the switches 24, 26, and 28, distrubutor devices 50, 52, and 54 are connected to the circuits of the solenoids 30, 32, and 34. The distributors 50, 52, and 54 although being shown as rotary mechanical devices may be provided in the form of solid state circuits or in any other acceptable form capable of sequentially opening and closing a circuit. As illustrated in the drawings the distributors are rotary members having lobes of any suitable arcuate length. The rotary distributors will be produced in a number of different configurations which may be utilized together to produce a large number of code combinations. The distributor rotors may be rotated individually or they may be mounted on a common shaft for simultaneous rotation.

For the purpose of supplying electrical energy for operation of the switching devices 24, 26, and 28 and for further altering the coded sequence of transmission and reception an aircraft identification code rotor 58 is incorporated such that each collision avoidance device has a different arrangement of arcuate contacts 68 and is mounted for rotation about an axis 60 that is connected to a power circuit 62 incorporating a source 64 of electrical potential. Although 58 is being shown as a rotary mechanical device it may be provided in the form of solid state circuitry or in any other acceptable form. The code rotor 58 is divided into fifteen increments, one increment being left blank, and the other increments including at least one arcuate contact 68 spanning each twenty-four degree increment. The arcuate contacts 68 are arranged in circular groups on the code wheel 58 for engagement by contacts 70, 72, and 74 disposed respectively at extremities of aircraft identification code circuits 76, 78, and 80. Contacts 82, 84, and 86 disposed at the other extremity of the aircraft identification code circuits 76, 78, and 80, respectively, are disposed for contact with the arcuate lobes of the associated distributor rotors 50, 52, and 54. As the aircraft identification code rotor 58 rotates and the distributor rotors rotate fifteen revolutions for each rotation of rotor 58 the switches 24, 26, and 28 will be energized when one of the contacts 70, 72, and 74 of the code identification circuits is disposed in engagement with one of the arcuate contacts of the identification code rotor while the contact of the other extremity of code circuit engages a lobe 56 of the associated distributor rotor 50, 52, or 54. The aircraft identification code rotor and associated distributor's rotors may be so related that one, two, or more of the associated switches 24, 26, or 28 may be simultaneously actuated to the receive position. Ordinarily only one of the switches 24, 26, or 28 will be energized to the transmit position at any one time but it is contemplated that two or more of the switches may be energized to the transmit position, if desired, without departing from the spirit and scope of this invention. In the embodiment of my invention illustrated in the drawings a single frequency is employed but it is to be understood that separate transmitters and receivers may be controlled by the switches 24, 26, and 28. All three of the switches will be maintained in the receive position as illustrated in FIG. 2 when the radio system is in the receive condition in order to assure positive reception of a signal being transmitted by the anti-collision radio system of an aircraft operating in the area. FIG. 1, for example, illustrates the aircraft identification code circuit 76 being energized by engagement between one of the inner arcuate contacts and the contact 70 while the lower contact 82 is disposed in engagement with a lobe 56 of the lower distributor rotor 54. The other two aricraft identification eode circuits 78 and 80 are not energized since neither of the contacts thereof is disposed in engagement with an arcuate contact or a contact lobe of a distributor rotor. Solenoid actuation circuit 88 connected to the lower distributor rotor 54 is therefore energized actuating the solenoid 34 thereby moving the switch 28 to its transmit position while the other switches 24 and 26 are maintained in the receive position because the solenoid actuation circuits 90 and 92 therefore are not energized.

The electrical circuitry of the aircraft anti-collision radio system illustrated in FIG. 2 is generally identical with respect to the basic circuitry illustrated in FIG. 1 except that the aircraft identification code rotor 94 is substantially different than the counterpart rotor illustrated in FIG. 1 in order to provide a different transmit-receive code sequence. The transmitter 102 and the receiver 104 of the radio system 93 respectively transmit and receive radio signals of the three designated tones on a designated radio carrier frequency of 75 MHZ for example. Radio signals transmitted and received are conducted through three switches 106, 108, and 110 that are actuated between the receive position illustrated in FIG. 2 and a transmit position by the combined effects of the aircraft code identification rotor 94 and the distributor rotors 96, 98, and 100 as described above in regard to FIG. 1. The aircraft identification code circuit 112 is disposed with both of its contacts out of engagement with an arcuate contact of the identification code rotor 94 or the distributor rotor 96. The solenoid 114 is therefore deenergized thereby allowing the switch 110 to be biased to its receive position allowing any received tone of 400 CPS to be conducted through the switch 110 thereby illuminating the indicator 116. The upper contact of aircraft identification code circuit 118 is disposed in contact with an arcuate contact of the code rotor 94 thereby energizing the conductor 118. The rotor 98 is disposed in a position with none of its lobes engaging the lower contact of conductor 118 thereby maintaining the solenoid 120 in a deenergized condition allowing switch 108 to be biased to its receive position allowing received tone signals of 1300 CPS to be conducted through the switch 108 thereby causing illumination of the indicator 122. The remaining aircraft identification code circuit 124 is disposed with both of its contacts out of engagement with either of the lobes of the distributor rotor 100 thereby causing the solenoid 126 also to be maintained in a deenergized condition allowing the switch 106 to be biased to its receive position whereby tone signals of 3000 CPS are conducted through the switch 106 to cause illumination of the indicator 128.

Like the anti-collision radio systems set forth in FIG. 1 the aircraft identification code rotor 94 and the distributor rotors 96, 98, and 100 will rotate and will cooperate to cause intermittent energization of each of the switch solenoids 114, 120, and 126 thereby intermittently moving the switches to their closed position in accordance with a preselected coded sequence that is so arranged that it may not duplicate the coded sequences of the radio systems of other aircraft.

The primary purpose for providing a blank space or null segment 66 in the aircraft identification code rotors is to provide a starting and stopping position for the signal code sequence emitted by the radio systems. As illustrated in the drawings the code rotors 58 and 94 are provided with fourteen code segments and a single null segment each being a 1/15 division of the respective rotor. As the rotors 58 or 94 rotate 1/15 of a revolution, the distributor rotors each rotate a complete revolution and actuate the respective switches in order to generate the particular code sequence assigned to the radio system involved. The blank space or null in each of the aircraft identification code rotors 58 and 94 of the anti-collision radio systems illustrated in FIGS. 1 and 2 also positively assures that at some time during the code sequence all of the switches will be maintained in the receive position thereby assuring reception and indication of any received signal on either of the tone circuits provided. For example, as illustrated in FIGS. 1 and 2 the anti-collision radio system of FIGS. 1 will be transmitting a tone signal of 3000 CPS because the switch 28 is biased to its transmit position by the energized solenoid 34 in response to relative positioning of the distributor rotor 54 and an arcuate contact of the identification code rotor 58. This signal will be received by the receiver 104 of the anti-collison radio system 93 and after suitable discrimination will be conducted through the switch 106 to the indicator 128 thereby indicating to the pilot of the aircraft that a signal has been received.

For the purpose of locating the bearing of an aircraft transmitting a signal that has been received, an automatic direction finding circuit 130 may be provided for the anti-collision radio system as illustrated in FIG. 1. The ADF circuit 130 includes an antenna circuit 132 coupled through a switch 134 to the ADF circuitry. The switch 134 is moved by a solenoid 136 between a position connecting the antenna circuit 132 to the ADF circuitry and a position where the antenna circuit is disconnected from the ADF circuitry. The solenoid 136 is energized when either of the solenoids 30, 32, and 34 of the basic anti-collison radio system are energized thereby causing the switch 134 to move to its position disconnecting the antenna circuit at any time one or more of the solenoids 30, 32, or 34 are energized. In the example where multi-frequencies are used, a separate automatic direction finding circuit for each radio frequency may be used. This feature assures that the ADF circuitry will not receive transmissions from its own radio system but rather will receive only signals transmitted from other aircraft. In one type of panel display the pilot viewing the instrument panel will see at least one of the visual indicators 44, 46, or 48 illuminated or audible signal at any time a signal is received by the receiver antenna. Additionally he will be able to determine direction from the ADF panel display of the aircraft from which the signal is received. By monitoring relative changes in the information displayed on the display panel the pilot may determine that continued flight in this direction may result in a collision and therefore may initiate an evasive maneuver in order to remove his aircraft from the possibility of collision. In another type of panel display a display 150 as illustrated in FIG. 1 can utilize the information from the ADF circuit, the signal strength, range rate, or time to collision, determined by the command computer 148.

The anti-collison radio system of my invention is capable of determining and advising the pilot of the time to possible collision in terms of predetermined time periods. For example, a pilot might desire to be warned if his aircraft is within one minute of possible collision thereby allowing ample time for appropriate evasive maneuvers or course changes in order to remove his aircraft from danger. This feature is accomplished by appropriate signal strength measuring circuitry incorporated into the circuitry of the receiver and which utilizes computer circuitry to identify particular changes in the signal strength being received from another aircraft. It is known that radio signals become stronger as the source of signal transmission is approached. Except for distortion and interference i.e., when traveling perpendicular to the wave front the signal strength generally changes inversely proportional to the square of the distance from the signal source. As one approaches the source of radio signals the signal strength will increase. The signal measuring circuitry of the receiver will measure the field strength of a radio signal being transmitted in accordance with a predetermined intermittent sequence pattern, at least one field strength reading is taken for each period the anti-collision system is in the receive position. For example, a signal field strength reading might be taken at 15 second intervals by the signal measuring circuitry. In this example if code wheel 58 of FIG. 1 is rotated every 15 seconds there may possibly be 96 or more separate readings for each rotation of the code wheel. These readings taken at the most advantageous point, or continuous measurements might be taken for each rotation of code wheel 58 and compared with the measurements taken on the previous rotation of the code wheel. At any time the field strength increases a certain predetermined amount within the selected time interval then the aircraft is a selected time period such as one minute from the signal source, therefore, meaning that the aircraft is one minute from possible collision. For the purpose of explanation only, one may assume that an aircraft is on a collision course with another aircraft. Since they are on a collision course the relative bearing of the two aircraft will not change, and therefore they will be traveling perpendicular to a wave front from each other. Disregarding interference and distortion, the signal strength will increase as they approach each other inversely proportional to the square of the distance from the power source (disregarding any acceleration or deceleration of either aircraft) the distance to collision actually is time to collision times velocity. The velocity is a constant in each collision incident. (Although the velocity is different for each collision situation.) Therefore, if the signal strength is known one minute and fifteen seconds before collision and fifteen seconds later the signal strength is 1.5625 times greater, the aircraft must be one minute from collision. It therefore follows that is a signal increases in field strength 1.5625 times or more in any fifteen second period, the aircraft will be one minute or less from possible collision. When the signal measuring circuit identifies a signal transmitted by the anti-collision circuitry of another aircraft indicating that a collision is possible within the predetermined time, a warning signal is energized in the form of an audible or visual signal or both, to advise the pilot that appropriate evasive maneuvers must be exercised immediately. The time to possible collision may be selected to give ample time in which the pilot may effect the desired maneuver. During this maneuver a signal is also transmitted continuously for a predetermined period (example 15 seconds) which is in the form of a tone command that gives an audible or visual signal or both through the appropriate receiver circuitry signalling the pilots of all other aircraft to maintain their present flight conditions while the first aircraft takes evasive action.

The anti-collision radio system of this invention may be further refined to include another form of evasive maneuver instruction which incorporates a command signal tone modulation generator 144, a command signal computer 146, and a command tone receiver and computer 148 illustrated in FIG. 1.

The first aircraft which determines an evasive maneuver is required will transmit instructions for the second aircraft to also take evasive action or maintain present flight conditions and to transmit a command which will cause all other aircraft receiving instructions from both maneuvering aircraft to maintain present flight conditions.

The command tone receiver and computer 148 along with command signal computer 146 are utilized to accomplish the particular evasive maneuvers desired in order to assure the pilot that a selected evasive maneuver displayed on panel display 150 would positively remove his aircraft from danger of collision. In the event the pilot of the aircraft is instructed by panel display 150 to maneuver his plane upwardly in order to avoid possible collision, the command signal tone modulation generator 144 will refer this signal to the command signal computer 146 which in turn will cause the transmitter 12 to transmit appropriate signals advising other aircraft operating in the area to fly downwardly or fly level depending upon the circumstances involved. In order to receive command signals transmitted by the anti-collision radio systems of other aircraft, additional circuitry of the command tone receiver and computer 148 is provided for the receiver circuitry 14 and is operative upon receiving an appropriate command signal from other aircraft to take appropriate evasive action in order to avoid possible collision. For example, in the event the transmitter circuitry of another aircraft, in response to the command signal computer thereof, transmits a fly up signal indicating that the other aircraft had initiated a downward maneuver, the command tone receiver and computer 148 will energize an appropriate indicator such as a directional arrow in order to indicate to the pilot the direction in which he should maneuver his aircraft in order to avoid possible collision. As illustrated in FIG. 1 a display means which might be a panel 150 may be provided with indicator devices in order to provide the pilot with an indication whether he should maneuver his aircraft upwardly, downwardly, to the right, to the left, or whether he should remain in level flight. In the event two or more other aircraft are operating in the area and each aircraft has transmitted opposing command signals indicating opposite maneuvers to avoid possible collision, both of these signals, if relevant to maneuvering of the aircraft receiving the transmissions, will through the command tone receiver and computer 148, advise the pilot to fly his aircraft straight and level or to execute any other appropriate maneuver.

The anti-collision radio system of this invention also may be provided with an altitude transducer 152 and an altitude rate of change transducer 154 as illustrated in FIG. 1 which transmit appropriate altitude and altitude rate of change signals to an altitude tone modulation generator 156. Appropriate circuitry in the transmitter 12 is energized by the altitude tone modulation generator 156 in order to cause the transmission by the antenna system 22 of such altitude and altitude rate of change tones on the carrier frequency. Other aircraft operating in the area will therefore be afforded a positive indication of the other aircraft altitude operating in the area. Altitude rate of change may also be shown by a single tone in place of a specific altitude tone, indicating that the aircraft is actually climbing or diving.

An altitude comparator circuit 159 is connected to the receiver circuit 14 and is also connected to the command tone receiver and computer 148. Altitude tone signals received through either of the receiver circuits will be conducted into the altitude comparator circuit which compares the signal received to the altitude of the receiving aircraft. In the event there is a substantial difference in operating altitude, i.e., greater than one thousand feet, for example, the command tone receiver and computer will eliminate the signal transmitting aircraft from consideration and the command display panel 150 will not be energized. In the event the transmitting aircraft is operating at or near the altitude of the receiving aircraft the altitude tone signals received will cause the command tone receiver and computer to energize an appropriate command indicator on the command display panel 150. It is apparent therefore that aircraft operating near a receiving aircraft will energize one or more of the indicators 44, 46, or 48, but no portion of the command display panel 150 will be energized unless the altitude comparator circuitry 159 and/or the signal strength measuring circuitry 157 provide the command tone receiver and computer with signal information that indicates a possible mid-air collision is imminent.

In view of the foregoing it is evident that I have provided a novel anti-collision radio system for aircraft and the like that utilizes a single or plurality of radio frequencies in order to allow both transmission and reception of radio signals between flying aircraft. The radio signals may be interpreted by the pilots of the various aircraft or may be fed into appropriate computer circuitry in order to advise the pilot of a maneuver which his aircraft should make in order to avoid possible collision. My anti-collision radio system incorporates transmitter and receiver circuitry capable of transmitting and receiving at least one and preferably three separate designated tones on a designated carrier frequency. Transmission and reception of the radio system is controlled by a plurality of switches that are provided for each tone circuit and which function in response to a coded sequence in order to cause intermittent coded transmission and reception of radio signals. The coded sequences determined by a plurality of distributor rotors that function in conjunction with an aircraft identification code rotor to energize or deenergize each switch circuit in accordance with a coded sequence. My invention is capable of simultaneous transmission of one or more specific tones and reception of one or more specific tones and thereby mathmatically assures probability of reception of at least one signal to indicate the presence of another aircraft operating in the area. The anti-collision radio system of my invention is adaptable to aircraft of all types and characters regardless of the size of the aircraft involved. It is not necessary that each aircraft be provided with expensive radio gear. Rather the invention at hand is adaptable to the use of radio gear of various degrees of sophistication and cost.

An aircraft utilizing an anti-collision radio system according to this invention may also be capable of transmitting command signals to other aircraft indicating the maneuver the aircraft has taken in order to avoid collision thereby providing a visual display of the direction the other aircraft should fly in order to positively avoid the hazard of possible collision. The radio circuitry may also include an altitude transducer and altitude rate of change transducer structure that function through an altitude tone modulation generator in order to cause the transmitter of the radio system to transmit signals indicating to other aircraft operating in the area the specific altitude and specific altitude rate of change of the aircraft thereby causing appropriate altitude comparator circuitry of the radio systems of other aircraft to identify the potential hazard or visually display the altitude condition of the aircraft transmitting the radio signal. It is readily understood therefore that my invention is well adapted to obtain all of the objects and advantages hereinabove set forth together with other objects and advantages that are inherent in the apparatus itself. While certain representative embodiments and details have been shown for the purpose of illustrating the invention it will be apparent to those skilled in this art that various changes and modifications may be made therein without departing from the spirit or scope of the invention.

I claim:

1. An aircraft anti-collision radio system for sending and receiving radio transmissions on the same radio frequency, said system comprising radio transmitter circuitry continuously transmitting radio signals of at least one designated tone, radio receiver circuitry continuously receiving said radio signals of said designated tone, transmitting and receiving antenna circuitry means for said system, indicator circuitry means capable of being energized upon receiving radio signals of said designated tone through said receiver circuitry, switching circuitry means for selectively completing the circuitry between said transmitter circuitry and said antenna circuitry means in a first operative condition thereof whereby radio signals of said designated tone are transmitted from said antenna circuitry means and completing the circuitry between said receiver circuitry and said indicator circuitry means in a second operative condition thereof for receiving radio signals transmitted from other aircraft, means for sequentially actuating said switching circuitry means to said first and second positions thereof in response to a coded sequence that is different in said radio system from the coded sequence of all other aircraft having a similar anti-collision radio system, whereby said radio system is capable of intermittently transmitting and receiving radio signals of said designated tone through said transmitting and receiving antenna circuitry means.

2. An aircraft anti-collision radio system as set forth in claim 1, said means for actuating said switch means comprising switch actuating circuitry including a source of electrical potential, at least one intermittent contact means capable of completing and breaking said switch actuating circuitry in accordance with a repetitive coded sequence.

3. An aircraft anti-collision radio system according to claim 1, said transmitting circuitry continuously transmitting radio signals of a given frequency and of a plurality of designated tones, said radio receiver circuitry being capable of discriminating said plurality of tone signals and including a plurality of tone circuits each being energized by selected ones of said plurality of tone signals, said indicator circuit means comprising a plurality of indicators each being energized by a selected one of said tone signals, said switching circuitry means including a switching circuit connected to each of said tone circuits.

4. An aircraft anti-collision radio system according to claim 3, a plurality of distributor circuits being electrically connected to selected ones of said switching circuits, said distributor circuits each having means for completing and breaking the associated distributor circuit in accordance with a coded sequence, whereby said switching circuits are energized to the first or second conditions thereof in response to the coded sequence of the associated distributor circuit.

5. An aircraft anti-collision radio system according to claim 4; aircraft identity code means including a plurality of code circuits connected to selected ones of said distributor circuits, said code means energizing and deenergizing said code sequence determined by said identity code means, whereby said distributor circuits are energized and cause energization of associated switching circuitry in accordance with the coded sequence of both said distributor means and said aircraft identity code means.

6. An aircraft anti-collision radio system as set forth in claim 1; altitude transducer circuitry and altitude rate of change circuitry provided for said radio system, altitude tone modulation circuitry being electrically connected to said altitude transducer circuitry and said altitude rate of change transducer circuitry and being connected to said trannsmitter, whereby said transmitter will also transmit modulated tones reflecting the altitude and altitude rate of change; altitude comparator circuitry connected to said receiver circuitry and being capable of comparing altitude signals received from other transmitters and comparing them with the altitude of the aircraft receiving the signals whereby a determination may be made whether or not the transmitting aircraft presents a hazard to operation of the receiving aircraft.

7. An aircraft anti-collision radio system as recited in claim 1; a command computer circuit having a command display to advise as to an evasive maneuver desired, signal strength measuring and comparator circuitry being connected to said receiver circuitry and being operative to sense increase or decrease in the strength of the signal being received and to transmit information regarding the relative increase or decrease in signal strength to said command computer circuit, said command computer circuit upon receiving information indicating a predetermined increase in signal strength being operative to energize a portion of said command display to advise as to the particular evasive maneuver desired.

8. An aircraft anti-collision radio system comprising radio transmitter circuitry transmitting a plurality of designated tones on a radio carrier signal of at least one designated frequency, a plurality of transmitter tone conductors being connected to said transmitter circuitry, a radio receiver having a plurality of receiver tone circuits one for each of said tones transmitted by said transmitter tone circuits, transmitting and receiving antenna circuitry for said radio system, a plurality of indicator circuits one being provided for each of said tones transmitted by said transmitter tone circuits, a plurality of electrically energized switching circuits completing connection between said transmitter tone circuitry and said transmitting antenna circuitry in a first operative condition thereof whereby transmitted signals will be conducted to said transmitting antenna circuitry, said switching circuitry completing connection between said receiver tone circuitry and said indicator circuits in a second operative condition thereof whereby tone signals received and discriminated by said receiver circuitry will be conducted to appropriate ones of said indicator circuits, a plurality of distributor circuits being connected one to each of said switching circuits and being operative to complete and break said switching circuits in accordance with a predetermined repetitive sequence determined by said distributor means, aircraft identification code means being provided for each of said distributor circuits, a plurality of code circuits being provided for electrical connection between said aircraft identification code circuitry and said switching circuitry, said aircraft identification code means being connected to a source of electrical potential and being operative to intermittently energize said code circuits in reponse to the code sequence of said aircraft identification code circuitry whereby said switching circuitry will be energized responsive to the combined code sequences of said aircraft identification code circuitry and said distributor means.

9. An aircraft anti-collision radio system according to claim 8; a command computer being connected to said receiver circuitry and having a command display, signal strength measuring circuitry being connected to said receiver circuitry and to said command computer, said signal strength measuring circuitry measuring relative increase or decrease in the field strength of the signal being received and transmitting signal strength information to said command computer, said command computer upon receiving information of a predetermined increase in the strength of the signals being received causing energization of a said command display to advise the pilot of the particular evasive maneuver desired.

10. An aircraft anti-collision radio system according to claim 8; a command computer being connected to said receiver circuitry and having a command display, an altitude comparator circuit being connected to said receiver circuitry and also being connected to said command computer, said altitude comparator being operative to eliminate all altitude tone signals but the particular tone signals relevant to the altitude at which the receiving aricraft is operating and also being capable of transmitting appropriate received altitude tone signals to said command computer, said command computer receiving information from said altitude comparator circuit and energizing said command display in order to advise the pilot of a maneuver that would remove his aircraft from the danger of possible collision.

11. An aircraft anti-collision radio system according to claim 8; an altitude tone modulation generator connected to said transmitter circuitry, an altitude transducer connected to said altitude tone modulation generator and being operative to transmit altitude tone signals to said altitude tone modulation generator whereby said transmitter will transmit coded signals indicating the particular altitude at which the aircraft is operating.

12. An aircraft anti-collision radio system according to claim 11; an altitude rate of change transducer being connected to said altitude tone modulation generator and being operative to transmit signals to said altitude tone modulation generator thereby causing said transmitter to transmit signals indicating the rate of change in altitude of the aircraft.

13. An aircraft anti-collision radio system according to claim 8; a command signal computer being connected to said transmitter circuitry, a command signal tone modulation generator being connected to said command signal computer and being responsive to a maneuver executed by the aircraft to transmit a command signal tone to said command signal computer, said command signal computer will in turn conduct signals to said transmitter resulting in the transmission of signals advising maneuvers if any to be executed by other aircraft operating in the area.

* * * * *